US006179417B1

(12) United States Patent
Lowry et al.

(10) Patent No.: US 6,179,417 B1
(45) Date of Patent: Jan. 30, 2001

(54) PROCESS FOR REDUCING BLOCKAGE IN NOZZLE HOLES FOR INK JET PRINTING

(75) Inventors: Edwina Floyd Lowry, Lexington; Paul Timothy Spivey, Winchester, both of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 08/368,452

(22) Filed: Jan. 4, 1995

(51) Int. Cl.[7] ..... B41J 2/175
(52) U.S. Cl. ..... 347/87
(58) Field of Search ..... 347/85, 86, 87; 134/10, 42

(56) References Cited

U.S. PATENT DOCUMENTS

| | | | | |
|---|---|---|---|---|
| 4,794,409 | | 12/1988 | Cowger et al. | 347/87 |
| 4,824,487 | * | 4/1989 | Hefferman | 134/10 |
| 4,929,969 | | 5/1990 | Morris | 347/87 |
| 4,931,811 | | 6/1990 | Cowger et al. | 347/87 |
| 5,128,379 | | 7/1992 | Stone | 521/50 |
| 5,182,579 | * | 1/1993 | Haruta et al. | 347/87 |
| 5,387,379 | * | 2/1995 | Atarashi et al. | 134/10 |

OTHER PUBLICATIONS

"Hawley's Condensed Chemical Dictionary" Revised by Richard J. Lewis, Jr; p. 353, 1993.*

* cited by examiner

*Primary Examiner*—N. Le
*Assistant Examiner*—Judy Nguyen
(74) *Attorney, Agent, or Firm*—John A. Brady

(57) ABSTRACT

Blockage of the holes in an ink jet nozzle is greatly reduced by immersing the polyether polyurethane foam from the ink jet cartridge in cold water for a period of at least six hours.

13 Claims, No Drawings

PROCESS FOR REDUCING BLOCKAGE IN NOZZLE HOLES FOR INK JET PRINTING

TECHNICAL FIELD

The present invention is directed to ink jet printing. In particular, it is directed to a process for reducing blockage in nozzle holes by a prior treatment of the foam ink reservoir.

BACKGROUND OF THE INVENTION

In commercial manufacture of cartridges for ink jet printing, a number of the cartridges have been returned to the factory from the field as failures. The predominant mode of failure was that no ink came out of the cartridge at what was supposed to be the beginning of its life in use. The present invention provides a solution to blockage in nozzle holes of ink jet print heads.

DISCLOSURE OF THE INVENTION

It has now been discovered that the failure of ink to come out of the cartridges is due to blockage of the printhead's nozzle holes, and that this blockage is avoided by treating the polyether polyurethane foam pads which are often employed/found in the ink reservoir(s) of inkjet cartridges.

According to the present invention, the polyether polyurethane foam is treated by immersing it in cold de-ionized water for a period of at least six hours. The immersion can continue for up to about 72 hours, after which there is little reason to continue it any longer.

The immersion of the polyether polyurethane foam in water resulted in the removal of oily material which was identified as low molecular weight urethanes. We have also identified low molecular weight urethanes as the material blocking the holes in the nozzles.

It is believed that the foam contains residual materials from its manufacture, i. e., materials that are unreacted and materials which do not reach complete reaction or are a product of degradation in the foam manufacturing process. These materials are leached out by the water based ink and, with time, migrate to the nozzle plate causing nozzle blockage.

Most surprisingly, the water used in the present invention is preferably cold. Warm water, and even water at ordinary room temperature, do not work as well as cold water. The most preferred temperature for the water is 4° C., where the results are by far the most desired. The reason for this is not understood.

Treatment of the foam according to the present invention in no way harms the final results obtained. The treated foam of this invention was tested in production level print cartridges and the production level print cartridges having treated foam performed comparable to functional print cartridges having untreated foam. The testing included such parametric measurements as drop mass, drop velocity, drop rise time, flooding, life test and print quality.

BEST MODE OF CARRYING OUT THE INVENTION

Dry, uninked polyether polyurethane foam is placed in containers of de-ionized water (water bath) and saturated with the water. The water bath is maintained at 4° C. for a time period ranging from about 6 to about 72 hours. The foam is removed from the water and pressure is applied to remove the cold water and any residual material. The foam is then rinsed in ambient de-ionized water with pressure applied periodically over a 3 minute time span so that the foam is thoroughly rinsed. The foam is then placed in a 60° C. oven for drying as part of an inkjet print cartridge manufacturing process.

Chloroform extraction of samples of a piece of foam before and after this cold water cleaning process demonstrate that there is an average decrease of 44% in the percentage of non-volatile residue, i. e., low molecular weight urethane. The decrease ranged from 25 to 62% with the greatest numbers being achieved with the longer periods of time in the cold water.

What is claimed is:

1. A process for removing an oily material from polyether polyurethane foam ink pads used in reservoirs of ink jet print cartridges, comprising the steps of a) contacting said polyether polyurethane foam ink pads with cold deionized water for a period of at least about six (6) hours and b) removing said polyether polyurethane foam pads from contact with said cold deionized water.

2. A process for removing oily material from polyether polyurethane foam ink pads in accordance with claim 1 wherein said cold deionized water is at a temperature of about 4° C.

3. A process for removing oily material from polyether polyurethane foam ink pads in accordance with claim 1 wherein said time period is not to exceed about 72 hours.

4. A process for removing oily materials from polyether polyurethane foam ink pads in accordance with claim 1 wherein said contacting is achieved by immersing the polyether polyurethane foam ink pads in a water bath.

5. A process for removing oily material from polyether polyurethane foam ink pads in accordance with claim 1 wherein said oily material are low molecular weight compounds.

6. A process for removing oily material from polyether polyurethane foam ink pads in accordance with claim 5 wherein said low molecular weight compound are urethanes.

7. A process for removing oily material from polyether polyurethane foam ink pads in accordance with claim 4 wherein said process further comprises the step of removing said polyether polyurethane foam ink pads from said water bath.

8. A process for removing oily material from polyether polyurethane foam ink pads in accordance with claim 7 wherein said polyether polyurethane foam pads are subject to pressure after removal from the water bath in order to remove deionized water and oily materials.

9. A process for removing oily material from polyether polyurethane foam ink pads in accordance with claim 8 wherein said polyether polyurethane foam pads are rinsed with deionized water and periodically subjected to pressure to remove additional deionized water and oily materials.

10. A process for removing oily material from polyether polyurethane foam ink pads in accordance with claim 9 wherein said polyether polyurethane foam pads are dried in an oven after said ink pads are rinsed and subjected to pressure.

11. A process for removing oily material from polyether polyurethane foam ink pads in accordance with claim 10 wherein said dried polyether polyurethane foam pads are placed in said reservoirs of said ink jet print cartridges, and loaded with ink.

12. A process for removing oily material from polyether polyurethane foam ink pads in accordance with claim 1 wherein from about 25% to about 62% of all oily materials present in the pads after manufacturing are removed from the polyether polyurethane foam pads.

13. A process for removing oily material from polyether polyurethane foam ink pads in accordance with claim 1 wherein said process is a step in an inkjet print cartridge manufacturing process.

* * * * *